US006487376B1

(12) United States Patent
Wang et al.

(10) Patent No.: US 6,487,376 B1
(45) Date of Patent: Nov. 26, 2002

(54) UPGRADEABLE IMAGING SYSTEMS WITH CONFIGURABLE PRINTING ROUTINES

(75) Inventors: Bobo Wang, Palos Verdes Estates, CA (US); Jon Hu, Palos Verdes Estates, CA (US)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/902,335

(22) Filed: Jul. 10, 2001

(51) Int. Cl.[7] ..... G03G 15/00

(52) U.S. Cl. ..... 399/12; 399/75; 399/110; 399/112; 399/118

(58) Field of Search ..... 399/8, 9, 12, 13, 399/38, 107, 110, 111, 112, 116, 118, 125, 75; 347/115, 118

(56) References Cited

U.S. PATENT DOCUMENTS 5,752,137 A * 5/1998 Haneda ..... 399/112 X
6,029,018 A * 2/2000 Rogers, IV et al. ..... 399/12
6,198,890 B1 * 3/2001 Liu et al. ..... 399/107

* cited by examiner

*Primary Examiner*—Sophia S. Chen
(74) *Attorney, Agent, or Firm*—Sonnenschein Nath & Rosenthal

(57) ABSTRACT

An upgradeable imaging system includes a housing with an opening. A support structure and a plurality of imaging stations are disposed within the housing. Each imaging station includes a charging unit and a developing unit. The imaging system also includes a removable module with a photoreceptive substrate. The removable module has an interior space defined within the photoreceptive substrate and at least one exposing unit disposed within the interior space. The removable module is configured to be engageable with the support structure and passable through the opening of the housing. When the removable module is engaged with the support structure, the photoreceptive substrate is disposed operatively adjacent to the imaging stations. Accordingly, the removable module may be removed from the imaging system and replaced with another module. The imaging system includes circuitry for configuring the imaging stations to operate according to a printing routine depending upon the number of exposing units.

10 Claims, 9 Drawing Sheets

UPGRADEABLE IMAGING SYSTEMS WITH CONFIGURABLE PRINTING ROUTINES

BACKGROUND OF THE INVENTION

1. Field of the Invention

The present invention relates generally to imaging systems such as electrophotographic (EPG) printers and copiers. More particularly, the present invention relates to imaging systems that are configurable in terms of printing routines, such a single-pass imaging, two-pass imaging, and so on. The imaging systems of the present invention utilize a removable module that allows a user to upgrade the imaging system with a module of higher quality (i.e., greater speed, better resolution, and so on) and then to reconfigure the printing routine based on the number of exposing units included in the replacement module.

2. Description of Related Art

Once exclusive to large companies, photocopiers and laser printers have become ubiquitous in homes and in businesses large and small. Photocopiers and laser printers operate according to electrophotographic (EPG) printing technology. Advances in EPG technology has enabled manufacturers to meet the demand for high-quality laser printing and copying of the small office/home office (SOHO) market. For example, many manufacturers design and market moderately priced "personal" photocopiers that operate at moderate speeds of about eight pages to ten pages per minute (ppm). Complementing affordable photocopiers, there are a number of moderately priced laser printers on the market that also operate at these moderate speeds.

While color inkjet printers are commonplace, the same is not so for color EPG systems. Color photocopiers and laser printers are large and expensive. With respect to color laser printers, the footprint of such systems (i.e., the area of a surface occupied by a printer), as well as the vertical clearance, is nearly twice as large as that of a monochrome (i.e., black-only printing) model. In addition, the price of color laser printers is nearly twice as high as that of monochrome models with comparable printing speeds.

Although larger and more expensive, color EPG printers have a clear advantage over inkjet printers in workgroup environments where a printer is connected to several users. Affordable color inkjet printers print at very slow speeds, such as 2 ppm or 3 ppm for high-resolution images, which is unacceptable in workgroups. Only the most expensive color inkjet printers are able to print at moderate speeds of 10 ppm, which is still too slow for effectively functioning in a workgroup environment. Accordingly, if it is desired to connect a color printer in a workgroup, then the printer needs to be a color laser printer.

Large size and high price of laser printers result from complicated EPG printing arrangements and processes. Standard EPG printing processes consist of six basic steps: charging, exposing, developing, transferring, fusing, and cleaning. For a general discussion of six-step printing processes, see, for example, pages 2110 to 2116 by Robert C. Durbeck in *The Electrical Engineering Handbook,* 2nd ed. (CRC Press, Boca Raton, Fla., 1997), the entire disclosure of which is incorporated herein by reference. For a more detailed discussion of six-step printing processes, see, for example, pages 26 to 49, of *Electrophology and Development Physics,* 2nd ed., by Lawrence B. Schein (Laplacian Press, Morgan Hill, Calif., 1996), the entire disclosure of which is also incorporated herein by reference.

Standard color printing involves the use of four differently colored toners: yellow, magenta, cyan, and black. Conventional color laser printers include a printing station with components for carrying out the charging, exposing, and developing steps. To print in color, the six-step EPG process is carried out for each color toner, that is, four times, which results in slow printing speeds. In order to operate at higher speeds, conventional EPG color printers are provided with additional printing stations, with each printing station dedicated to one of the four colors. While such an arrangement increases speed, the additional printing stations. accordingly increase cost, size, and complexity.

In view of the foregoing, there is a tradeoff in the art of color laser printing between speed and cost. For example, if a user wants to print at high speeds, then an expensive printer needs to be purchased. If a user is on a budget, then a slower and more affordable printer needs to be purchased, and if such a user foresees increased printing needs in the future, then a higher quality printer will need to be purchased in the future. Accordingly, there remains a need in the art for imaging systems that are able to print at moderate speeds at an affordable price and that are upgradeable to be able to print at higher speeds.

SUMMARY OF THE INVENTION

In preferred embodiments, the present invention provides upgradeable imaging systems and methods for upgrading imaging systems. The imaging systems of the invention enable users to purchase a moderately priced imaging system such as a color laser printer or a color photocopier that operates at moderate speeds, e.g., 8 pages per minute (ppm), and then to reconfigure the imaging system at a later time to operate at higher speeds, e.g., 16 ppm or 18 ppm.

According to one aspect of the invention, a preferred embodiment of an imaging system includes a plurality of imaging stations for forming an image on a sheet and a removable module including a photoreceptive substrate. An interior space is defined within the photoreceptive substrate in which at least one exposing unit is disposed. The imaging system also includes support structure for receiving the removable module, with the removable module being configured to be engageable with the support structure and, when engaged, to be disposed in an operative relationship with the imaging stations. In addition, the imaging control circuitry includes imaging control circuitry for configuring the imaging stations to operate according to a printing routine based on the number of exposing units.

The imaging systems of the present invention have a number of advantages, one of which is that the speed and, accordingly, the price of the imaging system may be changed by only changing the number of exposing units disposed on the removable module. An example of this advantage will be provided in the context of color electrophotographic (EPG) imaging where four imaging stations are provided, one for each of the four color toners: yellow, magenta, cyan, and black. In this context, the imaging system may be manufactured with a removable module with only two exposing units, which may include light-emitting diode (LED) print heads (LPHs). The imaging system may then be configured to operating according to a two-pass imaging routine. The speed of such a two-pass imaging system is moderate. As LPHs are expensive, the price of such an imaging system is moderate as there are only two exposing units.

However, a user may desire to upgrade the imaging system by acquiring a removable module with four exposing units. The two-unit module may be removed and then replaced with the four-unit module. The imaging system may then be configured to operate according to a single-pass imaging routine, which is essentially twice as fast as a two-pass system. This upgradeable feature of the present invention allows a user on a budget to purchase a moderately priced imaging system that operates at moderate speeds to upgrade the imaging system in the future with a module that configures the system to operate at faster speeds.

Other aspects of the present invention are directed to determining the number of exposing units on a module and configuring the imaging system to operate according to an imaging routine based upon the number of exposing units. For example, the removable module may include an on-board memory on which is stored data indicated of the number of exposing units. The imaging control circuitry may then access the module memory to determine the number of exposing units and then configured the imaging routine accordingly.

Alternatively, the removable module may be assigned a unique identifier, and the imaging system may be connected to a remote station, e.g., via the Internet. The remote station may include a database corresponding the unique identifier with the number of exposing units. Circuitry on the imaging system may then retrieve data from the database indicative of the number of exposing units based on the unique identifier.

Other aspects, features, and advantages of the present invention will become apparent as the invention becomes better understood by reading the following description in conjunction with the accompanying drawings.

DESCRIPTION OF THE INVENTION

Figure 1:
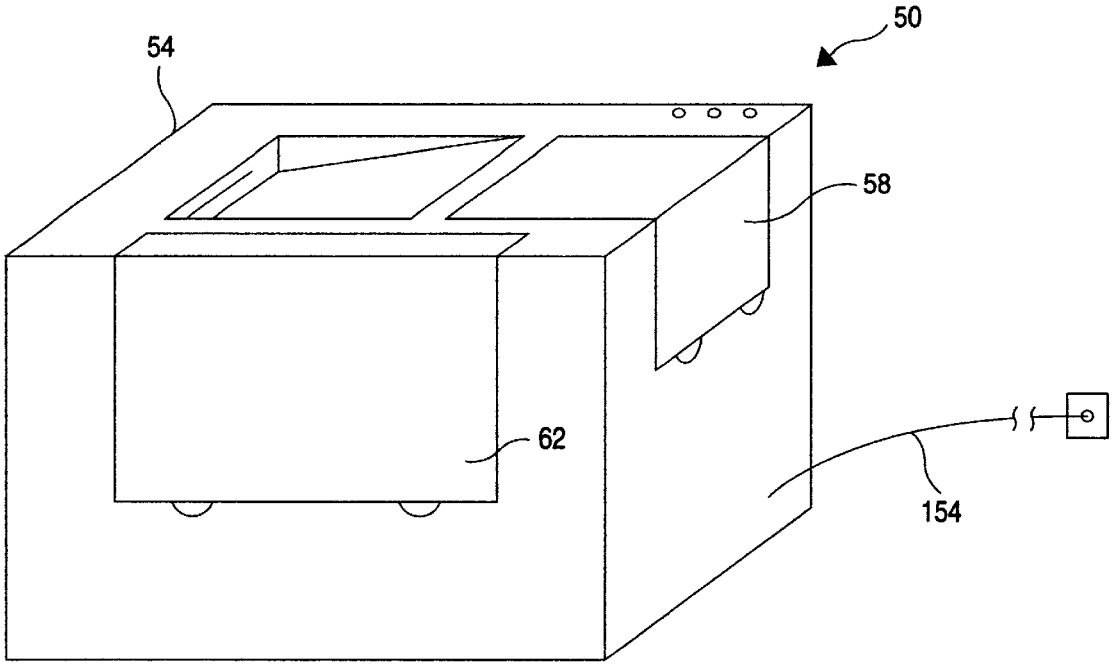
FIG. 1 is a perspective view of an upgradeable and easily serviceable imaging system configured in accordance with the principles of the present invention.
Figure 2:
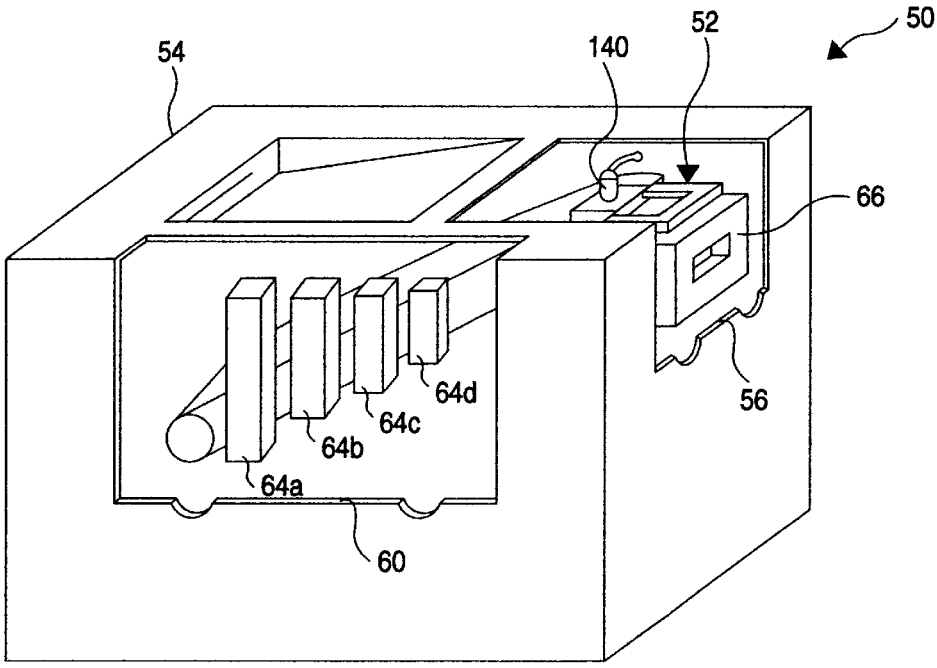
FIG. 2 is a perspective view of the imaging system of FIG. 1, particularly illustrating the imaging system with access doors removed.

Referring to the drawings in more detail, an imaging system 50 with a removable module 52 is illustrated in FIGS. 1 and 2 according to an exemplary embodiment of the present invention. Exemplary imaging system 50 includes a housing 54 with one or more openings each with a door or cover. In the embodiment shown in the drawings, exemplary accessible housing 54 has two openings: a module opening 56 with a cover 58 and a toner opening 60 with a cover 62.

As specifically shown in FIG. 2, exemplary removable module 52 is configured to be accessed. via and passable through the module opening 56. Accordingly, a user without specialized technical skills is able to remove exemplary module 52 easily for replacement or repair, which will be discussed in detail below. In addition to providing easy access the removable module, exemplary imaging system 50 is configured to provide easy access to one or more toner containers 64*a*, 64*b*, 64*c*, 64*d* via the toner opening 60 and to a waste toner receptacle 66 via the module opening 56, which will also be discussed in detail below.

Figure 3:
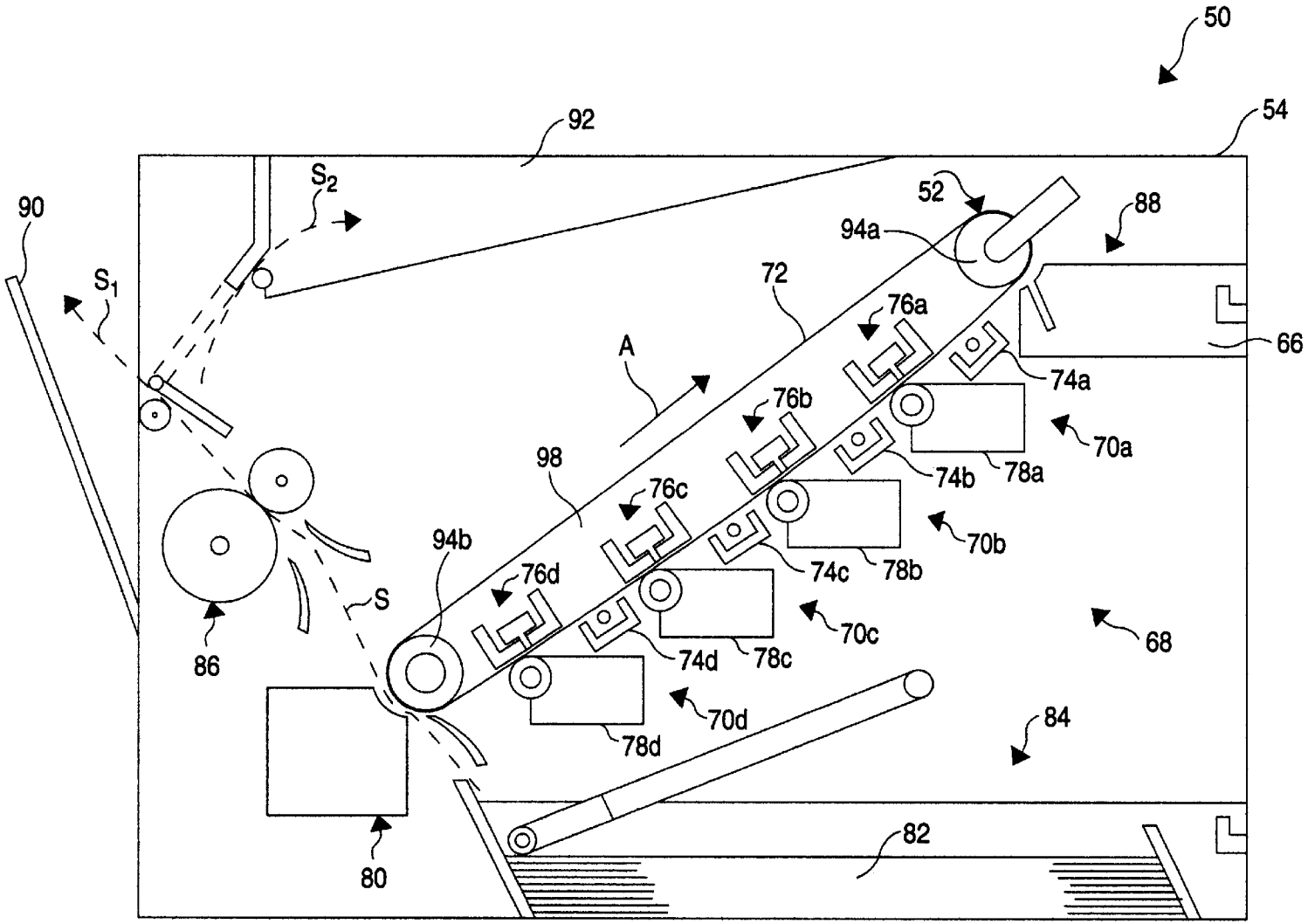
FIG. 3 is a side elevational view of an upgradeable and easily serviceable imaging system of the present invention, particularly such a system with a removable photoreceptor module.

With continued reference to FIGS. 1 and 2 and additional reference to FIG. 3, exemplary imaging system 50 includes components for forming images on sheet material such as paper, particularly color images. The principles of the present invention are described herein in the context of an electrophotographic (EPG) printing system as illustrated in the drawings but are equally applicable to other devices such as laser printers and photocopiers in which images are formed electrophotographically on sheet material.

The imaging system 50 of the present invention includes an imaging subsystem 68 with components for carrying out the basic steps of EPG imaging processes, that is, charging, exposing, developing, transferring, fusing, and cleaning. More specifically, exemplary imaging subsystem 68 includes four imaging stations 70*a*, 70*b*, 70*c*, 70*d*, with each station 70 being capable of forming a latent image and, in turn, a toner image in a respective one of the four standard colors (i.e., yellow, magenta, cyan, and black) on a photoreceptive substrate 72. Exemplary EPG imaging subsystem 68 may be configured in embodiments other than that illustrated in FIGS. 3 and 4, examples of which are shown and described in U.S. patent application Ser. No. 09/413,290, now U.S. Pat. No. 6,198,890 the entire disclosure of which is incorporated herein by reference.

Each imaging station 70*a*–70*d* includes a charging unit 74*a*, 74*b*, 74*c*, 74*d*; an exposing unit 76*a*, 76*b*, 76*c*, 76*d*; and a developing unit 78*a*, 78*b*, 78*c*, 78*d*. Downstream from the sequential imaging stations 70 is a transferring unit 80 for transferring the toner images formed by the imaging stations 70 onto a piece of sheet material such as a sheet of paper 82 from a sheet feeder 84. A fusing unit 86 for fixing the transferred toner to the sheet material is disposed within a sheet path S. A cleaning unit 88 (which includes the waster toner receptacle 66) is,disposed upstream from a first one of the imaging stations 70 for cleaning residual toner and contaminants from the photoreceptor 72. Sheet material with fused images may follow either a first output sheet path $S_1$ to a first receiving tray 90 or a second output sheet path $S_2$ to a second receiving tray 92.

For the purposes of this description, exemplary photoreceptive substrate 72 is configured as a belt supported and driven by at least two rollers 94*a* and 94*b*, although other photoreceptive substrates such as drums are within the scope of the present invention. The rollers 94 drive the photoreceptive substrate 72 in a direction indicated by arrow A.

Figure 4:
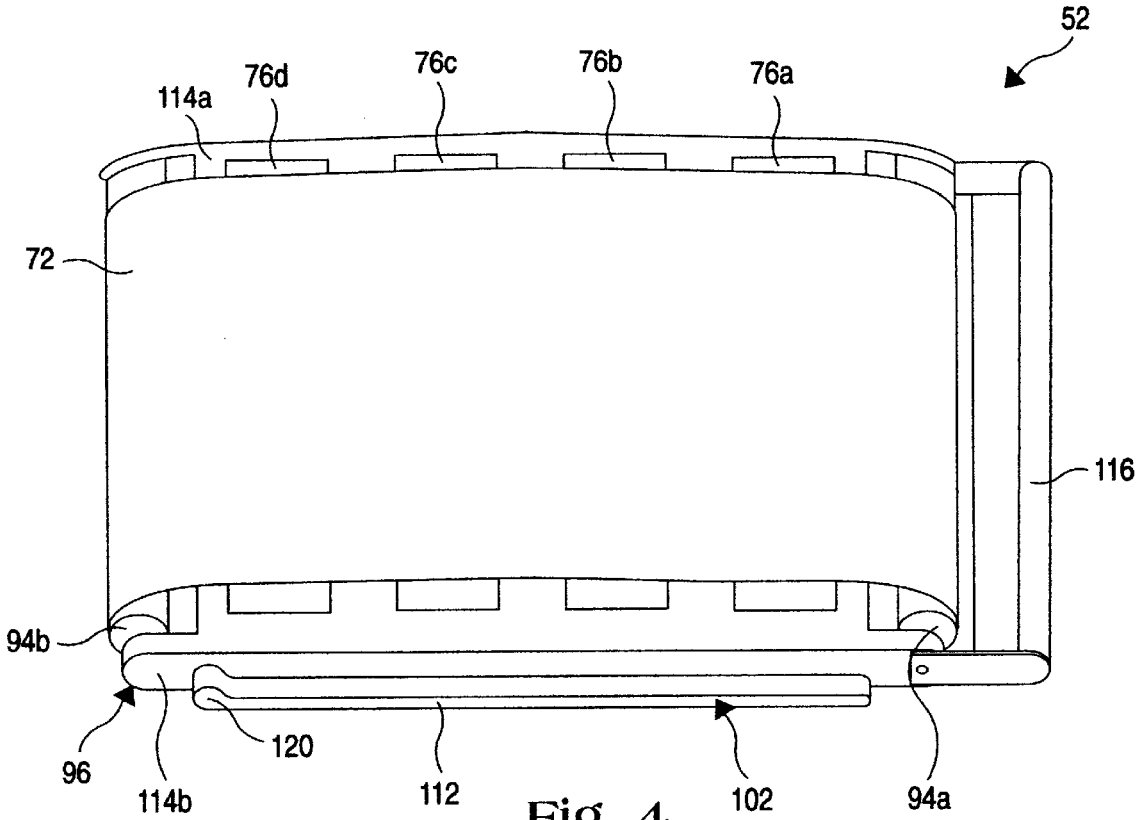
FIG. 4 is a perspective view of a removable module of the present invention.

With additional reference to FIG. 4, an exemplary embodiment of the removable module 52 of the present invention includes the photoreceptive substrate 72 and the exposing units 76 of the imaging subsystem 68. In addition, exemplary module 52 includes a frame assembly 96 for providing structural support for the module and on which the exposing units 76 and the rollers 94 are mounted (for clarity, the frame assembly 96 is not shown in FIG. 3). The photoreceptive substrate 72 is mounted on the rollers 94 to define an interior space 98 in which the exposing units 76 are disposed.

Figure 5:
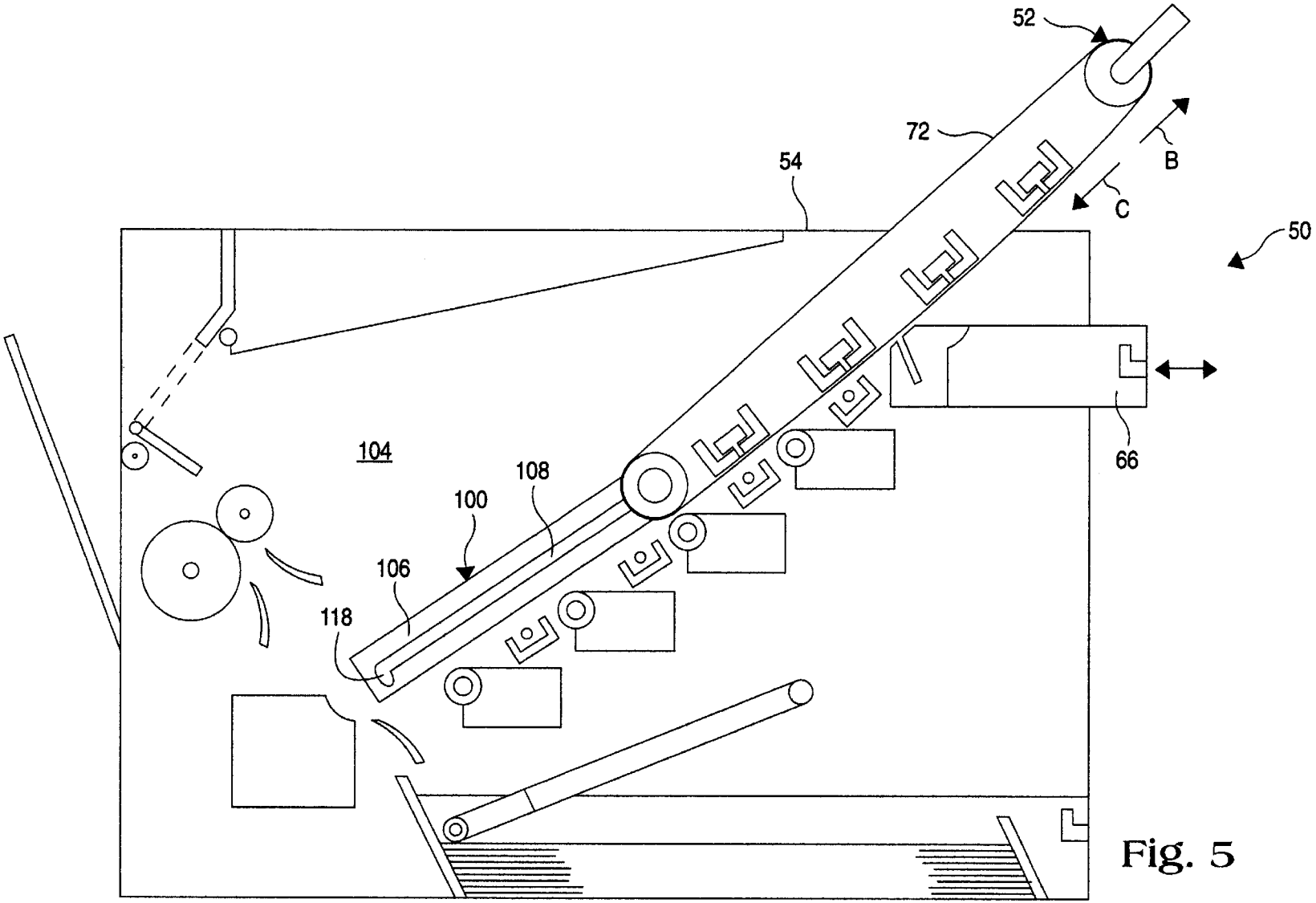
FIG. 5 is a side elevational view similar to that of FIG. 3, particularly illustrating of a photoreceptor module being removed (or inserted) into an imaging system of the invention.

Referencing FIGS. 4 and 5, exemplary imaging system 50 further includes support structure that is configured to retain the module 52 in an operative relationship within the imaging subsystem 68. The support structure of the present invention is exemplified in the drawings by a system support structure 100 disposed within the imaging system 50 and a module support structure 102 disposed on the module 52. The imaging support structure 100 may be mounted on a system frame 104 of the imaging system 50, and the module. support structure 102 may be mounted on the frame assembly 96 of the removable module 52. The respective support structure 100 and 102 are complementarily configured so that the module 52 is supported within, movable with respect to, and, preferably, releasably engageable with the imaging system 50.

Figure 6:
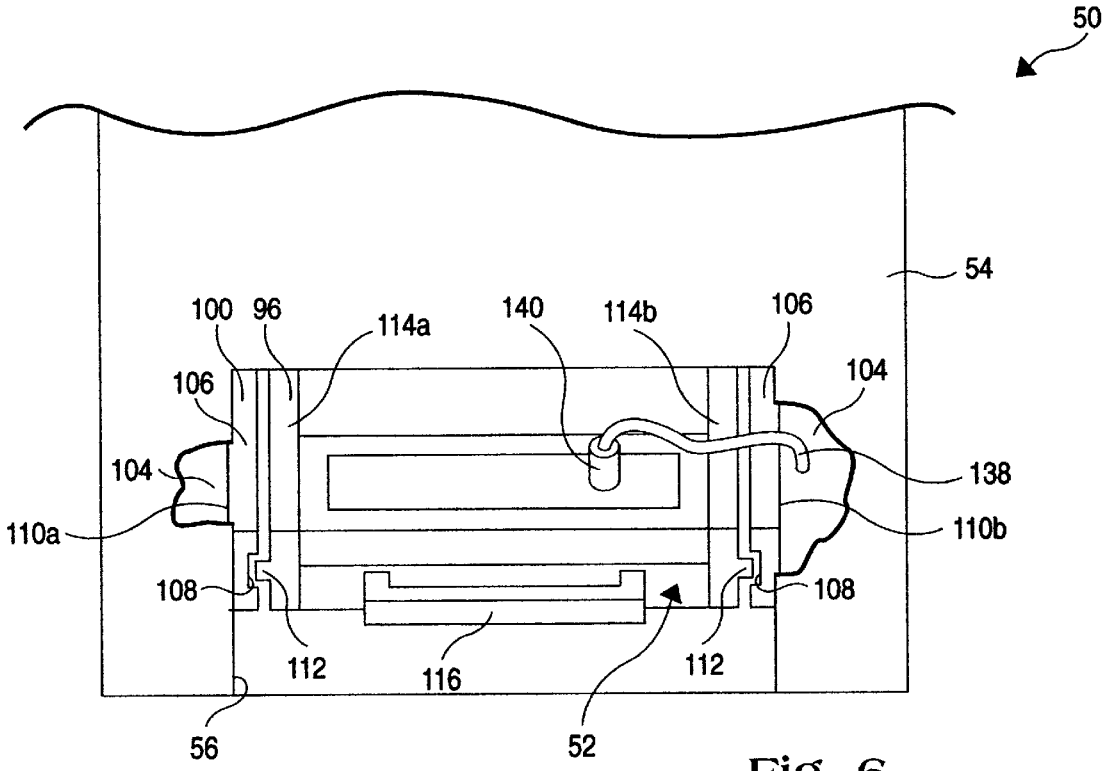
FIG. 6 is a fragmentary top plan view of an imaging system of the invention, particularly illustrating an exemplary connective relationship between a removable module and a system frame.

More specifically, with additional reference to FIG. 6, exemplary system support structure 100 may include a pair of elongated guides 106 each with a longitudinally disposed slot 108. The guides 106 may be mounted along transversely opposing inner sides 110*a* and 110*b* of the system frame 104. Additionally, exemplary module support structure 102 may include a pair of elongate bosses 112 each configured to be slidably receivable within one of the slots 108. The bosses 112 may be mounted on transverse sides 114*a* and 114*b* of the frame assembly 96 of the module 52. For the purposes of this description, the terms "transverse," "longitudinal," and "normal" are used in corresponding reference to the x axis, y axis, and z axis, respectively, of the Cartesian coordinate system as shown in FIG. 2.

In normal imaging operation, exemplary module 52 is received within the imaging system 50 in an engaged position as shown in FIG. 3 in which the imaging stations 70 operation in conjunction with the photoreceptive substrate 72 to form images. To remove, exemplary module 52 is urged outwardly from the engaged position as shown by arrow B in FIG. 5. A handle 116 may be attached to the frame assembly 96 to facilitate the removal of the module 52 by a user. The module 52 may then be serviced and re-inserted into the imaging system 50 as. shown by arrow C in FIG. 5. Alternatively, once removed, the module 52 may be replaced by a different module, for example, a module that is configured to print at a higher speed, which will be discussed in more detail below.

The support structure of the present invention may be configured to releasably engage the module 52 within the system frame 104 of the imaging system 50. For example, each of the slots 108 may include a detent 118, and each of the bosses 112 may include a protrusion 120 for releasably engaging with a respective one of the detents 118 to secure the module 52 in the engaged position within the system frame 104. As shown in FIG. 3, the photoreceptive substrate 72 is disposed in an operative relationship with the charging units 74 and the developing units 78 when the removable module 52 is in the engaged position. In addition, the exposing units 76*a*–76*d* are preferably spatially disposed between the charging units 74*a*–74*d* and the developing units 78*a*–78*d*, respectively, when the module 52 is in the engaged position.

Those skilled in the art will appreciate that the support structure may include any number of modifications to enhance the removing and the engaging processes, such as devices for releasably locking the module 52 in the engaged position and devices for spatially adjusting the module 52 to optimize the alignment or positioning thereof within the system frame 104. In addition, as alternatives to the slots 108 and the bosses 112 shown in the drawings, exemplary support structure may include any type of device or structure that enables the module 52 to be removable from the system frame 104, such as cams, shafts, pins, races, tracks, levers, grooves, gears, and so on.

Figure 7:
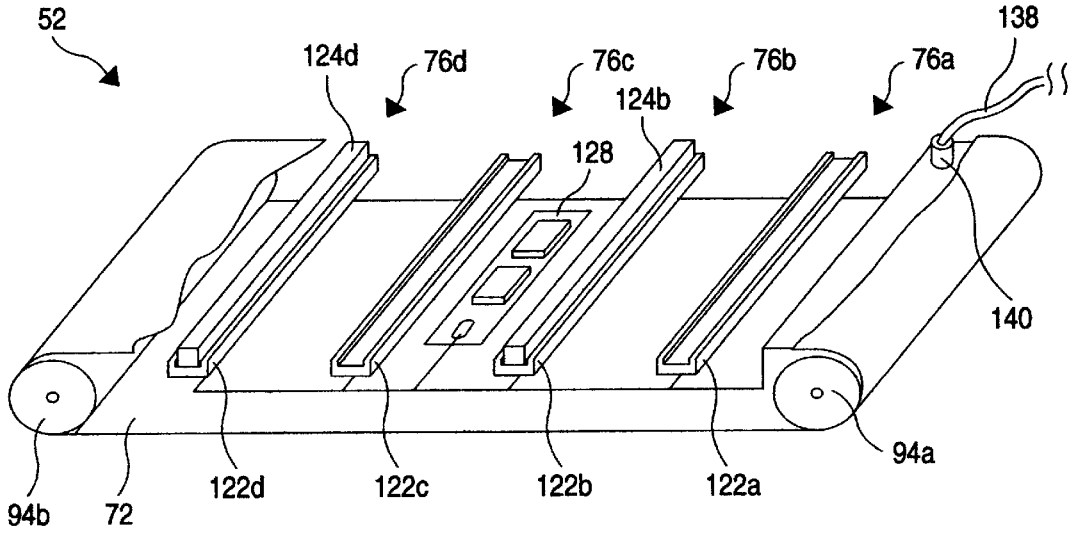
FIG. 7 is a perspective view of a removable module of the invention with a photoreceptive substrate partially cut away to illustrate exposure units of the invention.
Figure 8:
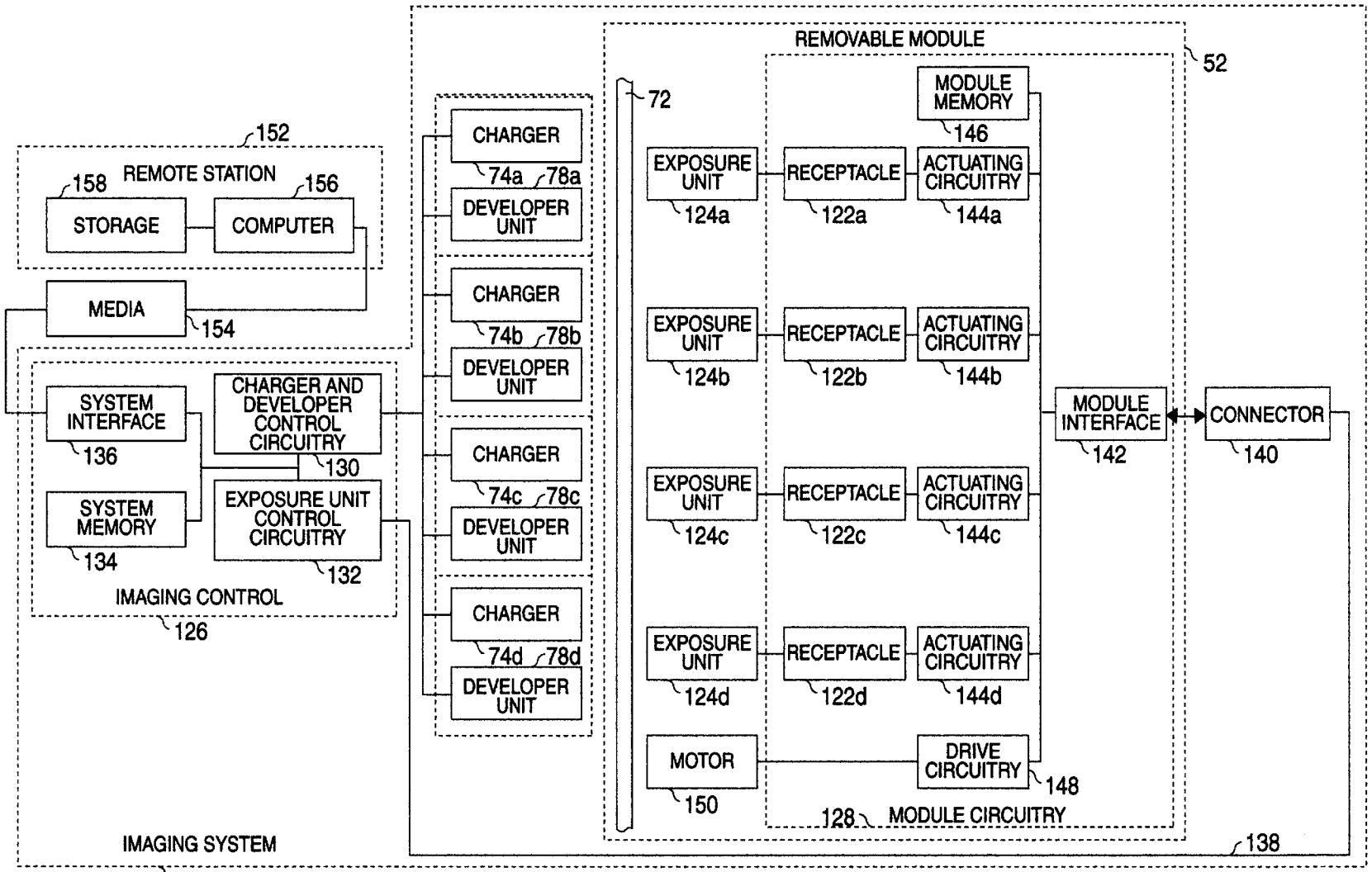
FIG. 8 is a block diagram of an upgradeable and easily serviceable imaging system of the present invention.

As mentioned above, one of the advantages of the imaging system 50 of the present invention is that the removable module 52 enables the system to be easily serviced or upgraded. Reference is made to FIGS. 7 and 8 with regard to the upgradeable feature of the invention. According to the present invention, each of the exposing units 76*a*, 76*b*, 76*c*, 76*d* of exemplary module 52 may include a receptacle 122*a*, 122*b*, 122*c*, 122*d* and an exposure element 124*a*, 124*b*, 124*c*, 124*d*. Within this arrangement, exemplary module 52 may be configured to include any number of exposure elements 124. For example, the module 52 shown in the exemplary embodiment of FIG. 7 includes two exposure elements, i.e., exposure elements 124*b* and 124*d*, which elements are shown in phantom line in FIG. 8.

As particularly shown in FIG. 7, each of the exposure elements 124 is illustrated as a linear exposure unit array such as a light-emitting diode (LED) print head (LPH). Those skilled in the art understand that LPHs have a plurality of linearly arranged LEDs and appreciate that LPHs are one of the most expensive components of an EPG imaging system. Accordingly, the present invention provides an imaging system that is LPH configurable. More specifically, in a color embodiment, the toner containers 78*a*–78*d* of the developing units 78*a*–78*d* contain yellow toner, magenta toner, cyan toner, and black toner, respectively. If four exposure elements 124 are provided on the module 52, then the imaging subsystem 68 is able to produce a color image with a single pass (i.e., one revolution) of the photoreceptor substrate 72 (i.e., the imaging system is a single-pass system). If two exposure elements 124 are provided, then the imaging subsystem 68 is able to produce a color image with two passes of the photoreceptive substrate 72 (i.e., the imaging system a two-pass system). If one exposure element 124 is provided, then the imaging subsystem 68 is able to produce a color image with four passes of the photoreceptive substrate 72 (i.e., the imaging system a four-pass system).

Intuitively, a single-pass configuration with four exposure elements 124 is the most expensive system but produces images on sheet material at the greatest rate, e.g., 18 pages per minute (ppm). A two-pass configuration with two exposure elements 124 is a less expensive system but produces images at a lower rate, e.g., 8 ppm to 10 ppm. And a four-pass configuration with one exposure element 124 is the least expensive system and, accordingly, produces images at the lowest rate, e.g., 4 ppm or 5 ppm.

In the marketplace, a single-pass imaging system with four exposure elements 124 is particularly useful in workgroups with a number of users, while a two-pass system with two exposure elements 124 is more suitable for a home office, both in terms of cost and speed. However, if a two-pass system is initially purchased and a user would like to upgrade to a faster machine, the imaging system 50 of the present invention allows the user to upgrade with the purchase a module 52 with four exposure elements 124. In this regard, it is not necessary to provide the two-element module 52 shown in FIG. 7 with receptacles 122*a* and 122*c*. Alternatively, rather than purchasing a new four-element module, a technician may be sent to the site to install two additional exposure elements 124 in the vacant receptacles 122, which, in the embodiment shown in FIG. 7, would be receptacles 122*a* and 122*c*. After a new module is installed, the imaging system 50 may be reconfigured to operate in accordance with a single-pass printing routine.

In this regard, with continued reference to FIGS. 7 and 8, exemplary imaging system 50 may include imaging control circuitry 126, and exemplary module 52 may include module control circuitry 128. Exemplary imaging control circuitry 126 may include both circuitry 130 for controlling the charging units 74 and the developing units 78 and circuitry 132 for controlling the exposing units 76, specifically the exposure elements 124. The imaging control circuitry 126 may also include a system memory 134 and a system interface 136, which will be discussed in more detail below.

As shown in FIG. 8, exposing unit control circuitry 132 may be connected to the removable module 52 by a cable 138 with a connector 140 which engages with a module interface 142. As shown in FIGS. 2, 6, and 7, the imaging system 50 is preferably configured so that the cable 138 may be easily connected and disconnected with the module 52 through the module opening 56 by a user to facility removal and insertion. In addition to the module interface 142, exemplary module circuitry 128 may include actuating circuitry 144*a*, 144*b*, 144*c*, 144*d* respectively connected to the exposing units 76*a*–76*d*, particularly the receptacles 122*a*–122*d*. The module circuitry 128 may also include a module memory 146 and drive circuitry 148 for driving a motor 150 for the rollers 94.

In accordance with the principles of the present invention, exemplary removable module 52 may be configured to sense the number of exposure elements 124 disposed therein and, therefore, to determine an appropriate imaging routine (e.g., two pass, single pass, etc.). For example, the module memory 146 may store data indicative of the configuration and the number of exposure elements 124 for each removable module 52. Further, the module memory 146 may store data indicative of the signature of each exposure element 124. For example, if the exposure elements 124 are LPHs, then the module memory 146 may store data relating to the position of each LED in the LPH, which data can then be used to correct misalignment and to produce registered toner images. Alternatively, each of the receptacles 122 may be configured to send a signal to the imaging control circuitry 126 indicating whether or not an exposure element 124 is received thereby. The imaging control circuitry 126 may then initiate an appropriate imaging routine based on the number and the location of the receptacles 122*a*, 122*b*, 122*c*, and/or 122*d* receiving, an exposure element 124.

Other methods and apparatus of the present invention for determining the number and/or the location of the exposure units 124 may involve the use of the Internet. For example, the system interface 136 of the imaging system 50 may be connected to a remote station 152 via communication media 154 such as an industry-standard cable as shown in FIG. 1. The removable module 52 may include information that uniquely identifies the module and parameters thereof, such as a unique alphanumeric identifier. When new or replacement module 52 is installed within the imaging system 50, the imaging control circuitry 126 may initiate an initialization routine that determines the unique identifier of the new module. The imaging control circuitry 126 may then communicate the unique identifier to the remote station 152. In turn, the remote station 152, which may include a computer 156 and a storage device 158, may retrieve data specific to the unique identifier and the module.

Figure 9:
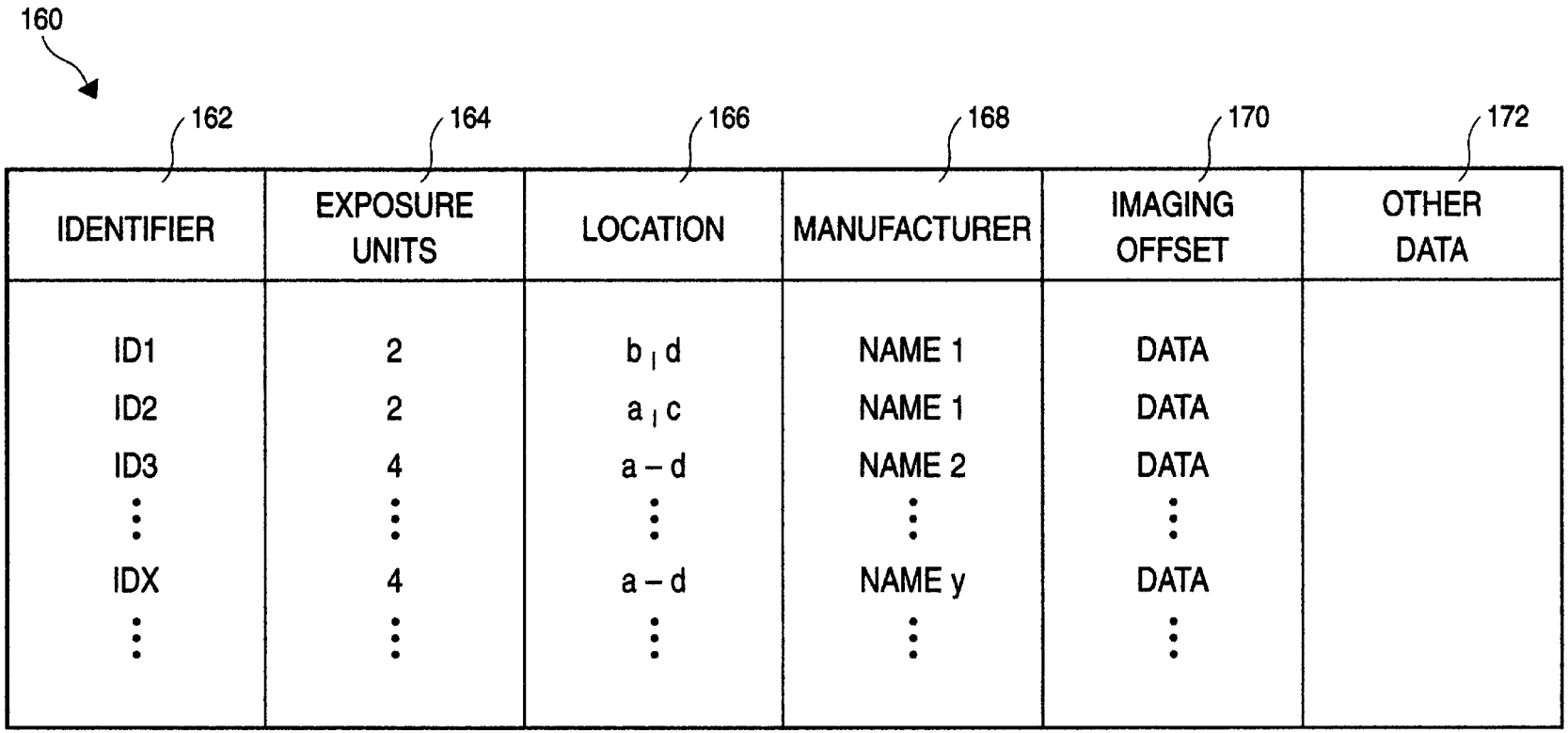
FIG. 9 is a table illustrating an exemplary database structure of the invention.

For example, with additional reference to FIG. 9, the storage device 158 of the remote station 152 may include a data-storage structure such as a database 160 containing information for all of the modules manufactured for the imaging system 50. As mentioned above, each module 52 may be assigned a unique identifier 162 with corresponding parameters and data. When instructed to do so, the computer 156 may retrieve from the database 160 all data relevant to a particular identifier 162. For example, if the module 52 shown in FIG. 7 has identifier ID1, then the computer 156 may retrieve and transmit to the imaging system 50 that the module 52 includes two exposure units 124 (which data are indicated by reference numeral 164, or data 164) located at the second and fourth receptacles, i.e., receptacles 122*b* and 122*d* (data 166).

In addition to the number and the location of the exposure units 124, exemplary database 160 may also include the name of the manufacture (data 168), data relating to imaging offset of the exposure units (data 170), and other data corresponding to the modules (data 172). As mentioned above, rather than retrieving data corresponding to a particular module from the remote station 152, such data may be stored on the module memory 146 or, alternatively, may be retrieved by a conventional storage medium (e.g., a CD-ROM). In any case, once the data are received, the imaging control circuitry 126 is able to initiate an appropriate imaging routine, taking into consideration the number and the location of the exposure units 124, as well as other relevant parameters such as imaging offset.

Figure 10:
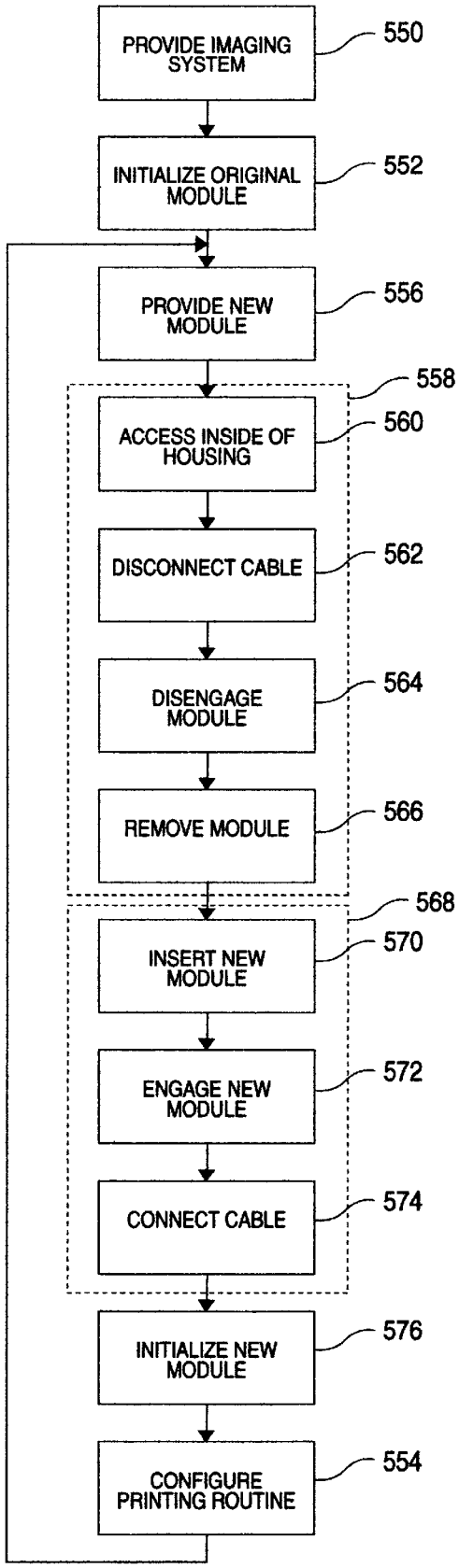
FIG. 10 is a flow chart illustrating exemplary methodology of the present invention for upgrading an imaging system.

Methodology in accordance with the foregoing procedure for upgrading an imaging system of the present invention is illustrated in FIG. 10. Upon providing the imaging system 50 of the present invention (550), the removable module 52 provided with the imaging system 50, e.g., at the time of purchase may be initialized (552). The initialization procedure may be accomplished with the use of the unique identifier 162 or by storing relevant data in the module memory 146. After initializing the module 52, the imaging control circuitry 126 may then configure the imaging subsystem 68 to form images in accordance with an appropriate printing routine based on the number and/or the location of the exposure units 124 (554). Alternatively, the original module 52 may have already been initialized, and the imaging system 50 may already have been configured with the appropriate printing routine at the time of purchase.

When it is desired to upgrade the imaging system 50 with a new module, e.g., of higher quality, the new module is acquired (556), and the original module 52 is removed (558). To remove, access is then provided to the housing 54 (560) via the module opening 56, and any cables such as cable 138 may then be disconnected (562). The module 52 may then be disengaged from the system frame 104 (564), e.g., by actuating locking devices, and urged outwardly through the module opening 56 (566).

Once the original module 52 is removed, the new (or replacement) module may then be installed (568) by firstly inserting the new module through the module opening 56 (570). If configured to do so, the new module may be engaged with the system frame 104 (572), e.g., by urging the protrusions 120 to engage with the detents 118 of the support structure, and the cable 138 may be connected to the module interface 142 (574). The new module may then be initialized as described above (576), e.g., through the use of a unique identifier and by retrieving data specific to the new module from the remote station 152. The imaging control circuitry 126 may then configure the imaging subsystem operate according to a particular printing routine, e.g., one-pass printing or two-pass printing as described above. The foregoing upgrade may be repeated as indicated by the feedback loop in the flowchart, particularly if the module is serviced rather than replaced.

As mentioned above, in addition to being easily upgradeable with a higher-quality module 52, exemplary imaging system 50 also provides easy access to the toner containers 64. Referencing FIGS. 2 and 11, the imaging system 50 of the present invention is configured not only to allow easy access to the toner containers 64 but also to enable differently sized toner containers 64 to be employed in the system. This feature is particularly useful in color printer in which yellow, magenta, cyan, and black toner are used, where black is the most commonly used toner. Therefore, black toner is depleted more-rapidly than the other toners and, if not provided with a larger container, needs to be frequently refilled. In accordance with the present invention, the black toner container has 64*d*.

Figure 12:
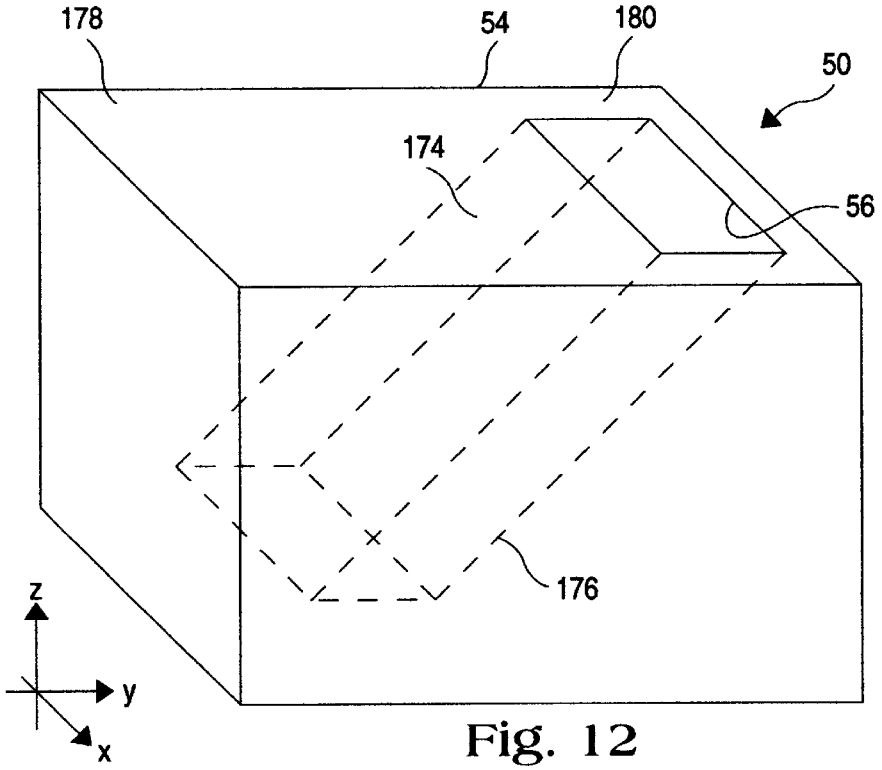
FIG. 12 is a perspective view illustrating an inclined inner space in relation to a housing of an imaging system of the present invention.
Figure 11:
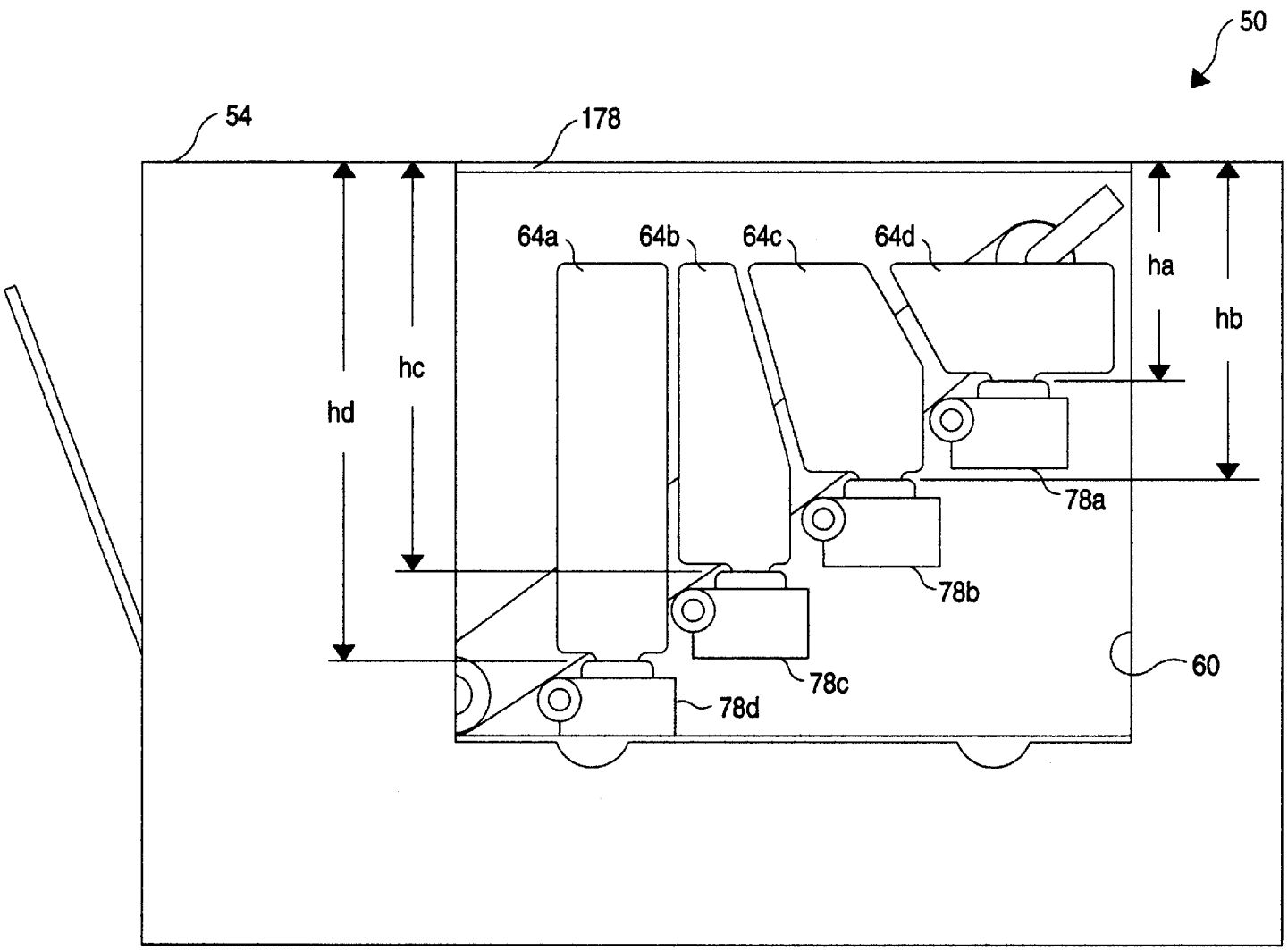
FIG. 11 is a side elevational view of an imaging system of the invention, particularly illustrating easily accessible toner containers.

The inclined configuration of the imaging subsystem 68 (see FIG. 3) within the imaging system 50 allows for differently sized toner containers 64. More specifically, as shown in FIG. 12, exemplary imaging system 50 has an inclined inner space 174 defined within the housing 54 in which the module 52 is receivable. With the developing units 78 disposed along a lower boundary 176 of the inner space 174, a height $h_a$, $h_b$, $h_c$, $h_d$, is respectively defined in the normal direction (i.e., along the z axis) between a top 178 of the housing 52 and each of the developing units 78, which heights are shown in FIG. 11. Height $h_d$ of developing unit 78*d* has the greatest magnitude and, therefore, is able to accommodate the largest toner container at least in terms of height. As the three other toners are used at relatively equal rates, the other toner containers 64*a*, 64*b*, 64*c* may be configured to have substantially equal volumes, for example, by increasing the longitudinal and/or transverse dimensions as the normal dimension decreases.

As shown in FIG. 12, the module opening 56 is preferably formed in a longitudinal end portion 180 of the top 178 of the housing 54, with the inner space 174 extending downwardly and diagonally therefrom. This angulated position of the inner space 174 minimizes the longitudinal dimension of the footprint of the imaging system 50. According to an exemplary embodiment, the inner space 174 and, accordingly, the removable module 52 (as well as the support structure) may be inclined with respect to the x-y plane by an angle of at least about 35° up to an angle of about 65°.

Upgrading and servicing principles for imaging systems of the present invention have been exemplified by the embodiments illustrated in the drawings. These principles are described in reference to an EPG imaging system with a photoreceptive belt. Numerous modifications and additions to the above-described embodiments would be readily apparent to one skilled in the art. One example of such a modification is to include a photoreceptive drum on the removable module 52, rather than a photoreceptive belt. Another modification is to implement the exposing units 76 as laser print heads rather than as LED print heads as described above.

It is intended that the scope of the present invention encompass all such modifications and/or additions. According, while not providing an exhaustive description of all the possible embodiments of the invention, the disclosure sets forth specific embodiments illustrating the best known approach for carrying out the novel and unobvious principles of the invention, the scope of which is limited solely by the claims set forth below.

What is claimed is:

1. An imaging system comprising:

a plurality of imaging stations for forming an image on a sheet;

a removable image receiving module including an image receiving substrate defining an interior space and at least one exposing unit disposed within the interior space;

a support structure for receiving the removable module, the removable module being configured to be engageable with the support structure, the image receiving substrate being disposed in an operative relationship with the imaging stations when the removable module is engaged with the support structure; and imaging control circuitry for configuring the imaging stations to operate according to a printing routine based on the number of exposing units.

2. An imaging system as claimed in claim 1 wherein the removable module has a unique identifier indicative of the number of exposing units disposed in the interior space;

the imaging control circuitry using the unique identifier to determine the number of exposing units.

3. An imaging system as claimed in claim 2 further comprising an interface for connecting the imaging control circuitry to a remote station.

4. An imaging system as claimed in claim 3 wherein the remote station includes a database corresponding the unique identifier to the number of exposing units;

the imaging control circuitry receiving the number of exposing units from the remote station.

5. A method for modifying an imaging system, the imaging system including a first removable module having at least one exposing unit and a plurality of developing stations each having a charging unit and a developing unit, the method comprising:

determining the number of exposing units in the imaging system; and configuring the imaging system to operate according to an imaging routine based on the number of exposing units.

6. A method as claimed, in claim 5 further comprising:

changing the number of exposing units in the imaging system; and configuring the imaging system to operate according to an imaging routine based upon the changed number of exposing units.

7. A method as claimed in claim 5 wherein the determining step comprises:

receiving the number of exposing units from a remote station.

8. A method as claimed in claim 5 wherein the determining step comprises:

receiving the number of exposing units from a memory.

9. A method as claimed in claim 5 wherein the imaging system includes four developing stations and two exposing units, the configuring step comprising:

configuring the imaging system to operate according to a two-pass imaging routine.

10. A method as claimed in claim 5 wherein the imaging system includes four developing stations and four exposing units, the configuring step comprising:

configuring the imaging system to operate according to a single-pass imaging routine.

* * * * *